US008383922B1

(12) United States Patent
Pittaway

(10) Patent No.: US 8,383,922 B1
(45) Date of Patent: Feb. 26, 2013

(54) DEVICE FOR CONTROLLING PICKING DEPTH FOR A STRINGED INSTRUMENT

(76) Inventor: George Pittaway, Midlothian, VA (US)

( * ) Notice: Subject to any disclaimer, the term of this patent is extended or adjusted under 35 U.S.C. 154(b) by 0 days.

(21) Appl. No.: 13/200,566

(22) Filed: Sep. 26, 2011

(51) Int. Cl.
*G10D 9/00* (2006.01)

(52) U.S. Cl. ..... 84/453; 84/267

(58) Field of Classification Search ..... 84/453, 84/267

See application file for complete search history.

(56) References Cited

U.S. PATENT DOCUMENTS

| | | | | | |
|---|---|---|---|---|---|
| 3,375,747 | A * | 4/1968 | Posey | 84/453 |
| 3,413,883 | A * | 12/1968 | Helbourne | 84/267 |
| 3,525,284 | A * | 8/1970 | Almeida | 84/453 |
| 4,394,830 | A * | 7/1983 | Damiano | 84/726 |
| 4,632,003 | A * | 12/1986 | Kopp | 84/723 |
| 4,649,793 | A * | 3/1987 | Blackshear et al. | 84/453 |
| 5,517,891 | A * | 5/1996 | Sica | 84/453 |
| 5,883,322 | A * | 3/1999 | Baker | 84/453 |
| 6,066,789 | A * | 5/2000 | Lisi | 84/267 |
| 6,262,354 | B1 * | 7/2001 | Solomon, Jr. | 84/329 |
| 8,278,538 | B1 * | 10/2012 | D'Anda et al. | 84/294 |

* cited by examiner

*Primary Examiner* — David Warren
*Assistant Examiner* — Robert W Horn
(74) *Attorney, Agent, or Firm* — David L. Banner

(57) ABSTRACT

An accessory for attachment to a stringed musical instrument that mechanically limits depth of picking action by providing interference to the finger, fingernail, or pick. A plate or "anvil" either flexible or rigid, is adjustably positioned beneath the strings to intercept and arrest a picking element. In a first embodiment, picking depth is roughly controlled my manually forcing the anvil up and down on a flanged support post. In a second embodiment, picking depth may be finely controlled by a knurled thumbwheel or similar mechanism on the anvil support posts. The flexibility of the plate provides a shock absorber, thereby creating a realistic feel to the player. The flexible plate assures both limitation of depth of picking action, and also renders picking action consistent as to depth.

14 Claims, 5 Drawing Sheets

DEVICE FOR CONTROLLING PICKING DEPTH FOR A STRINGED INSTRUMENT

FIELD OF THE INVENTION

The invention pertains to stringed musical instruments and, more particularly, to an accessory for controlling picking depth of stringed instruments.

BACKGROUND OF THE INVENTION

Stringed musical instruments, for example guitars and mandolins, etc. may be played by picking or plucking the strings by hand. Individual strings or groups of strings may be engaged by a finger, by a fingernail, or by a hand held pick. It will be appreciated that picking can be performed at a fairly fast pace, in terms of how many times per second a string, either one string or alternatively several different strings are to be plucked. Control over picking, where this applies to how any one string is engaged, moved, and released, has a significant influence over sounds resulting from the plucked string or strings as well as the amount of force required to move the picking finger, fingernail, or pick, from one string and on to the next.

Alternatively stated, quality of picking can result in desirable auditory results or in impaired auditory results.

One relatively significant variable in picking or plucking a string is the depth relative to the outer surface of the string being picked or plucked. As used herein, the term depth is used to denote that direction extending from above the face of an instrument, moving towards the strings and then past the strings towards the body of the instrument. This direction is typically substantially perpendicular to the planar face of the instrument, (i.e., the planar face located immediately beneath and facing the strings).

Lack of effective control of depth of picking can introduce distortions to the flow of the picking motion itself consequently altering the intended auditory result of playing. Timing and variation in lateral movement, (i.e., the mechanics) of the plucking element can all adversely affect the auditory result of playing. Consequently, a musician plucking a stringed instrument must concentrate on his or her picking action. If the musician is distracted by variations in the amount of force required to effectively/optimally strike the string, the auditory result of the picking may become less than satisfactory.

Therefore, there exists a need for assisting a musician in controlling picking action when picking strings of a musical instrument, particularly as control relates to depth of picking.

SUMMARY OF THE INVENTION

In accordance with the present invention there is provided an accessory for attachment to a stringed musical instrument that mechanically limits depth of picking action by providing interference to the finger, fingernail, or pick. A flexible plate or "anvil" is adjustably positioned beneath the strings to intercept and arrest a picking element.

In a first embodiment, picking depth is roughly controlled my manually forcing the anvil up and down on a flanged support post.

In a second embodiment, picking depth may be finely controlled by a knurled thumbwheel or similar mechanism on the anvil support posts.

The flexibility of the plate provides a shock absorber, thereby creating a realistic feel to the player. The flexible plate assures both limitation of depth of picking action, and also renders picking action consistent as to depth. However, it is possible that some players may prefer an inflexible, rigid plate.

Limiting depth of picking action overcomes the necessity of concentrating on consciously limiting picking depth, which in turn allows for more concentration on other aspects of playing the instrument. Also, reducing the travel of the picking element in the direction of depth causes more consistent controllable action in picking. In addition, unintended contact of the hand of the musician with the strings or other parts of the instrument is reduced when picking depth is limited.

A certain measure of psychological reassurance is provided as the problem of excessively deep picking is substantially overcome. Both accuracy and speed of picking may then be increased by either conscious or unconscious effort. The musician's ability is thereby enhanced.

In another aspect of the invention, the plate may be either roughly or finely adjustable as to its location between the strings and the face of the body of the instrument in that it may be positioned closer to the strings or closer to the face of the instrument as desired. This allows a user to selectively control both sonic and tactile elements of his or her playing.

Other benefits arising from the invention include safety, especially for children or others with slender fingers. Steel strings often utilized on musical instruments are typically thin and under high tension. Consequently, they may present a hazard. The invention limits the depth that a child's finger may travel below the plane of the strings thereby eliminating or minimizing cuts, scrapes, and/or blisters on the fingers of the picking hand caused by the taut steel strings.

Another benefit of the invention is that it provides a mechanical version of a compressor/limiter by facilitating constant attacks upon the instrument's strings. This may reduce the need for electronic compression or limiting and thereby reduce the electronic artifacts typically associated therewith.

It is, therefore, an object of the invention to provide a device for facilitating control of the picking of a stringed musical instrument.

It is another object of the invention to provide a device for facilitating control of the picking of a stringed musical instrument whereby picking depth may be controlled.

It is an additional object of the invention to provide a device for facilitating control of the picking of a stringed musical instrument by providing either a rigid or flexible plate or anvil that intercepts and arrests the travel of a pick in a direction substantially perpendicular to the upper face of the stringed instrument.

It is a further object of the invention to provide a device for facilitating control of the picking of a stringed musical instrument wherein an anvil is height adjustable with respect to the upper face and strings of the instrument.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a plate or anvil, typically flexible, adapted for adjustable height mounting on the soundboard of a stringed musical instrument such as a guitar beneath the instrument's strings. As solid body instruments do not include a soundboard per se, as used herein the term soundboard is meant to include the upper surface of a solid body instrument. In alternate embodiments, a rigid plate may be substituted to suite tastes of certain players. As used herein, the term flexible plate may have the term rigid plate substituted therefor. The anvil of the invention serves to control the depth of a pick when picking one or more strings of the instrument. Let x represent an ideal amount of force required to optimally pluck a string. Without the anvil in accordance with the invention, a guitarist might haphazardly encounter X for the first note, then X+3 for the next note, then maybe X−2, then X+2, resulting in inconsistent and possibly impaired attack on the strings. However with the anvil providing a more consistent string resistance, the guitarist may pluck each string with optimal X, X, X, X, force. The consistency provided by the novel anvil makes the instrument easier to play. It may also create a natural "compressor/limiter" wherein sound levels produced are more consistent. Electronic compressors/limiters are commonly used to amplify soft notes and attenuate loud notes being played.

Figure 1:
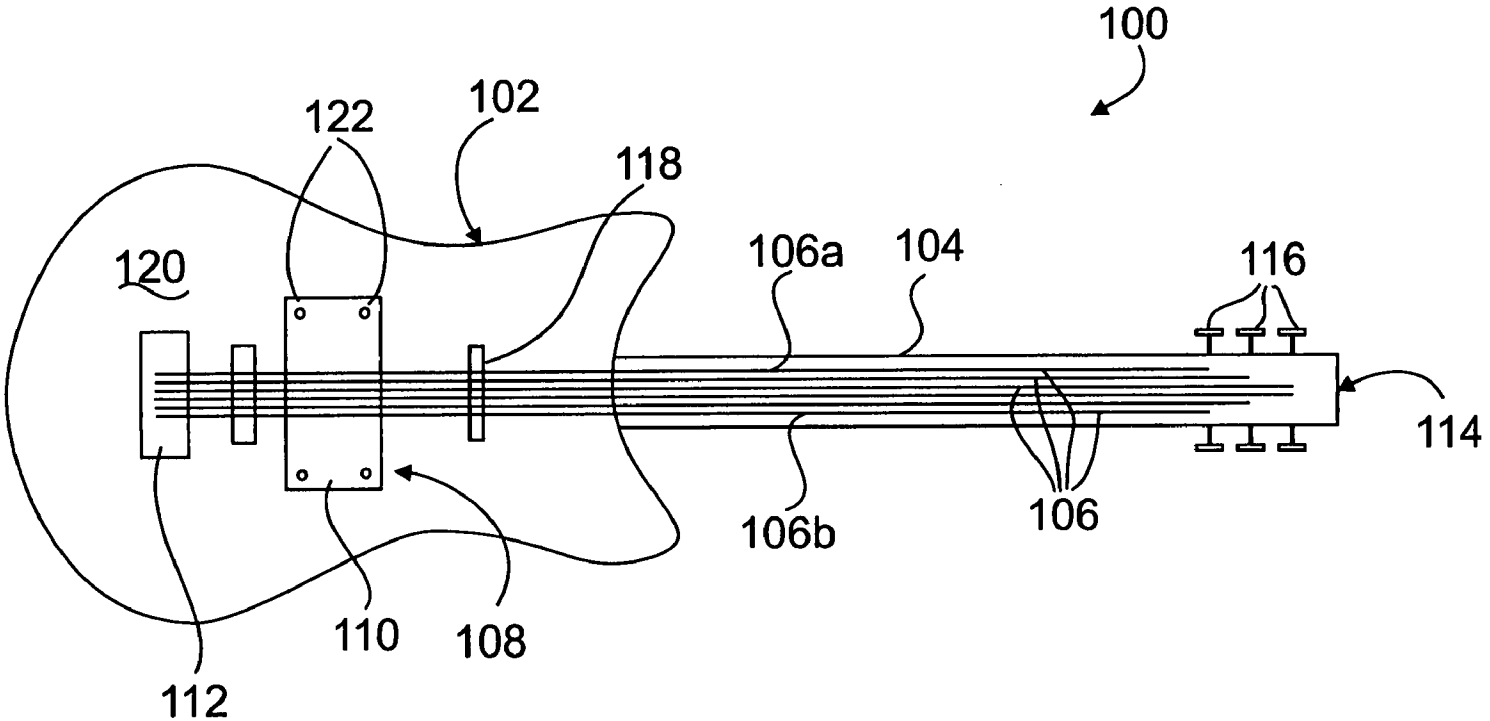
FIG. 1 is a top plan, schematic view of a stringed instrument having the picking depth control device in accordance with the invention installed thereupon.

Referring first to FIG. 1, there is shown a top plan view of a typical musical instrument 100 having the flexible or rigid plate 110 forming an anvil 108 of the invention secured upon the soundboard thereof. While a guitar has been shown for purposes of disclosure, it will be recognized that anvil 108 may be sized and configured for use with any other stringed musical instrument. Consequently, the invention is not limited to the guitar chosen for purposes of disclosure.

Stringed musical instrument 100 has a body 102, a neck 104, and strings 106, the combined length of body 102 and neck having a cumulative length sufficient to accommodate the length of strings 106. Stringed musical instrument 100 has a major axis, not specifically identified, parallel to strings 106 and a width extending in a direction perpendicular to the major axis. Strings 106 are typically coplanar and lie in a plane spaced apart from and substantially parallel to soundboard 120.

An anvil 108 is shown disposed on face surface (i.e., soundboard) 120. Stringed musical instrument 100 is of the type wherein the strings 106 are attached thereto for generating musical tones. The stringed instrument 100 may be an electrically amplified guitar for example, wherein the strings 106 are fixed at one end to a saddle 112, and at the other end to the headstock 114 of the stringed musical instrument 100. The strings 106 typically extend from saddle 112 along a soundboard 120 of the body 102 and neck 104 to headstock 114 spaced apart from one another and from soundboard 120 and neck 104. Strings 106 are typically coplanar.

The neck 104 is generally connected to and typically extends from the body 102. The headstock 114 may have conventional apparatus, not specifically identified, (e.g., tuning pegs 116, tuning keys, not shown, etc. for selectively tightening each one of the strings 106 for tuning purposes.

An electrical pickup, shown schematically at reference number 118, optionally may be provided to acquire energy signals by strings 106. Pickups 118 are believed to be well known, and are often affixed directly to the sound board 120 of a musical instrument such as musical instrument 100. The pickup(s) 118 act as transducers that capture mechanical vibrations from strings 106 and convert them to an electrical signal, not shown, which can be amplified and/or recorded.

Anvil 108 comprises a thin, substantially rectangular plate 110 that is mounted on soundboard 120 of the body 102, located between the soundboard 120 and the strings 106 spaced apart on legs in relation to both. Anvil 108 limits depth of picking action in the direction extending towards the body 102 of the stringed instrument 100. That is, fingers, fingernails, or a hand held pick (not shown) which engage the strings 106 when picking are intercepted and prevented from moving past anvil 108 in the direction of soundboard by anvil 108 (i.e., vertically along the Z-axis).

It is conceivable that a guitarist could obtain a depth-limiting effect by deliberately or accidentally picking over the upper surface of a pickup 118. However, pickups 118 typically have a width generally only slightly wider than the collective width of strings 106. In addition, if the pick or finger nail of the player's hand were to contact the transducer, spurious noise could be generated that would interfere with the musical sounds being picked up. Additionally, many pickups don't have smooth topsides, and those that do are often plated with precious metals which players are loathe to rub off because so doing would decrease the resale value of the entire instrument. The width of anvil 108 is typically significantly wider than smooth top-surface pickups 118 of the prior art. The additional width of anvil 108 provides a "runway" for the finger or pick, thereby allowing a smooth takeoff of the picking stroke, particularly when picking the outer strings.

Referring now also to FIGS. 2, 3*a*, 3*b*, and 4 there are shown detailed, side elevational, schematic views of a first embodiment of support leg 122 for the anvil 108, top plan schematic views of two embodiments of plates 110, mountings to fit contours of guitar surfaces, and pick guards however configured and an enlarged, detailed, side elevational, schematic view of a portion of the musical instrument 100 of FIG. 1. It will be recognized that the novel device for controlling a picking depth is equally useful when applied to acoustic instruments or to solid body instruments.

Figure 2:
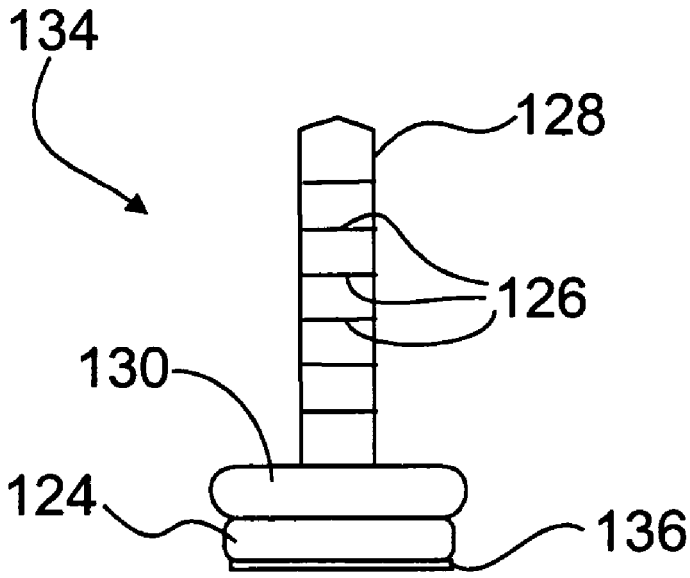
FIG. 2 is a side elevational, schematic view of a first embodiment of a mounting leg forming a portion of the anvil in accordance with the invention.

As best seen in FIG. 2, Legs 122 typically comprise headed fasteners 134 commonly bearing adhesive 124 on the head 130. Fastener 134 typically has a plurality of outwardly projecting ribs or flanges 126 disposed on the shaft 128 thereof. Because fastener 134 is typically fabricated from a slightly flexible synthetic resin, the flanges 126 are generally bendable. Adhesive 124 is typically protected by a film or membrane 136 that protects an outer surface of adhesive 124 from contamination. Such headed fasteners 134 are believed to be well known in the automotive industry and may be utilized as the legs 122. A catalog number 13454 nylon cowl vent retainer from Auto-Vehicle Parts Company (Au-Ve-Co Products) of Cold Spring, Ky. has been found satisfactory for the application. An alternate embodiment of leg 122 is discussed in detail hereinbelow.

With protective film or membrane 136 removed, legs 122 may be mounted on the soundboard or upper surface of a solid body electric instrument 120 without penetrating body 102 using adhesive 124. Holes 132 disposed in plate 110 of anvil 108 allows plate 110 to be selectively positionable along shaft 128 of fastener 134, plate 110 being retained between ribs or flanges 126 along fastener shaft 128. By selecting discrete positions along shaft 128, plate 110 may be crudely adjusted for height between soundboard 120 and the bottom of strings 106.

Figure 3A:
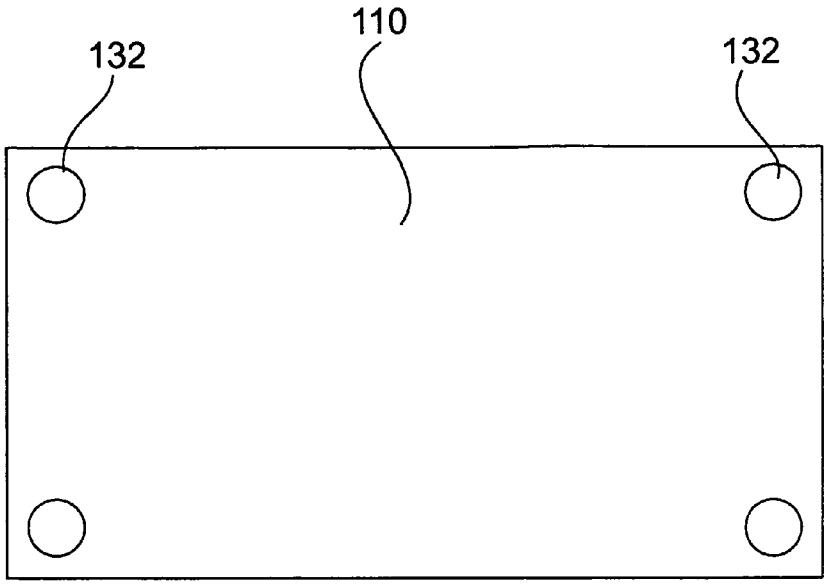
FIGS. 3*a* and 3*b* are top plan, schematic views of a first and a second embodiment, respectively, of a plate forming a portion of the anvil in accordance with the invention.
Figure 3B:
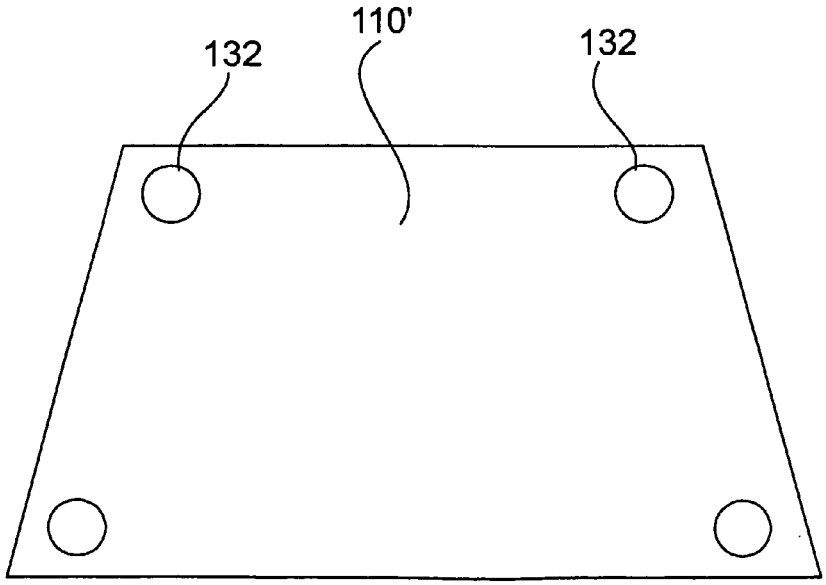

As may be seen in FIGS. 3*a* and 3*b*, a rectangular plate 110 and a trapezoidal plate 110', respectively, are shown. While a rectangular plate 110 has been chosen for purposes of disclosure, it will be recognized that other shapes such as the trapezoidal plate 110' of FIG. 3*b* may be chosen to accommodate a particular operating environment or circumstance. For example, decorative plates having irregular shapes may be used. Consequently, the invention is not considered limited to the rectangular plate 110 chosen for purposes of disclosure.

Figure 3C:
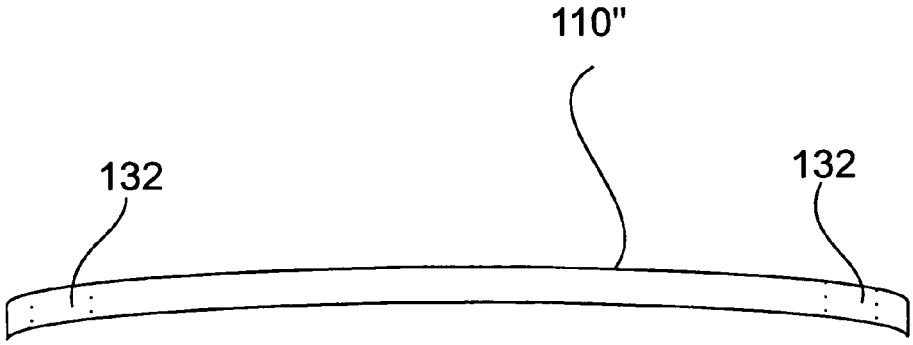
FIG. 3*c* is a side elevational, schematic view of a third embodiment of a plate forming a portion of the anvil in accordance with the invention.
Figure 4:
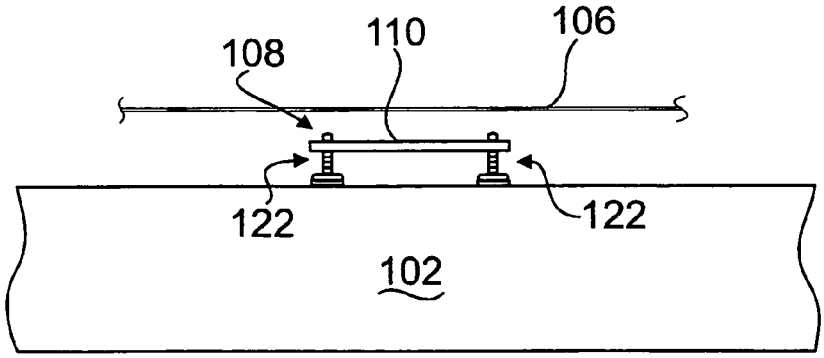
FIG. 4 is an enlarged, detailed, side elevational, schematic view of a portion of the musical instrument of FIG. 1.

Referring now also to FIG. 3*c*, plates 110. 110' may be provided as a substantially flat plate. In alternate embodiments, plate 110" may be provided with a slight curvature or bow as viewed from a front or rear edge thereof, neither specifically identified. The front or rear edge of plate 110 are the edges disposed orthogonally to the major axis of instrument 100.

Plates 110, 110', 110" may be fabricated from a flexible material such as a synthetic resin. For purposes of disclosure a nylon 6/6 material having a thickness of 0.062 inch has been chosen. It will be recognized that players may have a range of preferences regarding the degree of flexibility of plate 110. Consequently, plates 110, 110', 110" may be provided in a range of materials and/or thicknesses to provide for such preferences. Stiffness of plates 110, 110' 110" is chosen so as to retain its generally planar position, but preferably to deflect slightly in response to finger pressure during picking of the strings 106.

Holes 132 are formed in plates 110, 110', and 110". Holes 132 are sized and configured to receive and retain shaft 128 and ribs 126 of fastener 134 in plate 110. Holes 132 are typically disposed adjacent corners of plates 110, 110', and 110".

As used hereinafter, plate 110 is intended to include all disclosed variations (e.g., plate 110', 110"). As may readily be seen in FIG. 4, plate 110 of anvil 108 is typically supported in place on a plurality of legs 122 which are coupled to soundboard top 120 of body 102, typically by adhesive 124. A leg 122 is disposed proximate each of the corners of the plate 110 in holes 132. Legs 122 are disposed to hold the plate 110 at a selected height between soundboard 120 and a lower surface of strings 106. While four legs 122 have been chosen for purposes of disclosure, it will be recognized that more or fewer legs 122 may be chosen. Consequently, the invention is not limited to four legs but includes fewer than or more than four legs.

As is typical of most stringed instruments 100, the strings 106 are arrayed generally side-by-side and spaced apart from one another in a plane occupied thereby. It will be recognized that in some stringed instruments (not shown), the strings establish a slightly arcuate array rather than forming a purely planar array. However, in actual practice, this curvature typically does not substantially impair performance of anvil 108.

A spanning distance is defined between two outside strings 106*a* and 106*b* that are maximally spaced apart from one another. The separation distance separating string 106*a* from string 106*b* is greater than a comparable separation distance between any other two of the intermediate ones of strings 106.

Plate 110 overlies the soundboard 120 of body 102 with a long axis of plate 110 perpendicularly aligned to the major axis of body 102. This particular arrangement enables anvil 108 to function effectively, to be easily adjusted as to optimal position between soundboard 120 and strings 106, while being minimally disruptive in other ways to the playing of stringed instrument 100.

Figure 5A:
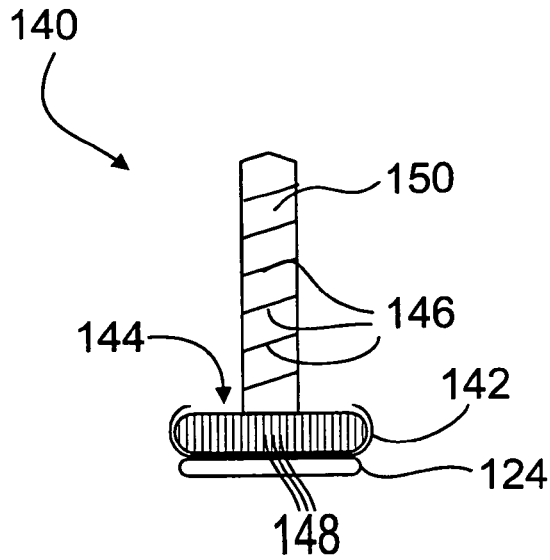
FIGS. 5*a* and 5*b* are side elevational and top plan schematic views, respectively, of a second embodiment of an adjustable support leg for the anvil in accordance with the invention.
Figure 5B:
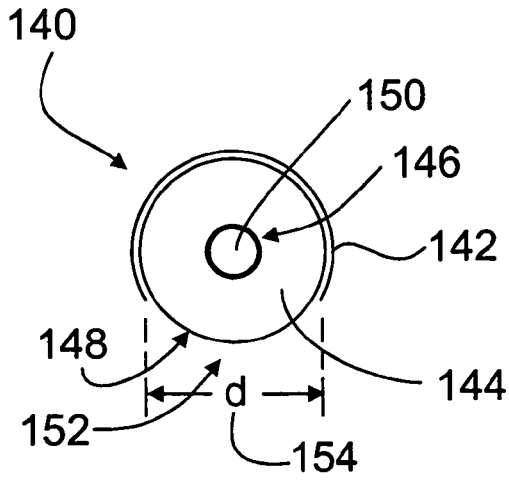

Referring now also to FIGS. 5*a* and 5*b*, there are shown side elevational and top plan schematic views, respectively, of an adjustable leg assembly 140 for use with anvil 108 of the invention. The embodiment of anvil 108 shown in FIG. 4 allows only limited adjustability of the height of plate 110 above soundboard 120. Such adjustability is determined by the pitch of ribs or flanges 126 onto which holes 132 in plate 110 are slid and retained, plate 110 typically being retained between adjacent ones of ribs or flanges 126. For many applications this adjustability may be sufficient. However, other applications may require a mechanism for more finely adjusting the height of plate 110 above soundboard 120.

Leg assembly 140 having a head 144 having a circumference containing knurls 148. Head 144 is loosely retained within retaining cup 142 such that head 148 may rotate therein. A portion of the perimeter 152 having a width "d" 154 of cup 142 is open (i.e., cut away), thereby exposing knurls 148 of head 144. Retaining cup 142 has adhesive 124 disposed on a lower surface, not specifically identified, to facilitate attachment of retaining cup 142 to soundboard 120 of stringed musical instrument 100.

In this embodiment, shaft 150 having threads 146 may be threaded into holes 132 of plate 110 by rotating head 144 of adjustable leg 140 using knurls 148 exposed through opening 152.

A shaft 150 extends from head 144 and has continuous threads 146 disposed on an outer surface thereof.

The invention also includes a method for limiting depth of penetration which plectrum (i.e., finger, finger nail, pick, etc.) can move when plucking the strings of a stringed instrument such as the stringed instrument 100. The method comprises a step of mounting a plurality of legs such as the legs 122 on the body of the stringed instrument at locations outside the strings 106, without penetrating the body of the stringed instrument. For example, adhesive mounting of the legs 122 avoids the necessity of drilling into or otherwise penetrating and permanently modifying and/or impairing body 102.

The method may comprise a further step of coupling to the plurality of legs a generally planar member such as the plate 108 between the strings and the body of the stringed instrument 100 in spaced apart relationship from both the strings 106 and the body 102, as described hereinabove.

The method may comprise a further step of incorporating into the legs 122 adjusters such as the ribs or flanges 124 which are disposed to hold the generally planar member 110 at a selected position with regard to distance from the body 102 and distance from the strings 106, as also described hereinabove.

In alternate embodiments, the simple plate 110 may be replaced by a thin display that may be used to provide information to the player of the instrument. Such displays using technologies such as organic light emitting diodes (OLEDs) are known to those of skill in the art and are not further described herein. The uses of such a display are virtually unlimited, ranging from presenting instructional information, music, analysis of technique, etc.

It will be recognized by those of skill in the art that one or more of the structural features of the present invention may conceivably be implemented as part of a pick guard or, alternately, as a feature in the top surface of a musical instrument itself. Such implementations of the novel concepts of the invention are seen to be included therein.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An apparatus for attachment to the soundboard of a stringed musical instrument for limiting the picking depth, comprising:

a) a plurality of mounting legs each having a head adapted for affixing to a soundboard of a stringed musical instrument and an elongated shaft disposed perpendicularly to and extending away from said head, said elongated shaft having a diameter and a plurality circumferentially disposed, resilient, spaced-apart ribs or flanges disposed therealong; and b) a thin, resilient plate having a shape chosen from the group: a rectangle, and a trapezoid disposed between a lower surface of a group of strings of said stringed musical instrument and a soundboard thereof, said thin, resilient plate being disposed substantially parallel to said soundboard and having a width, and a through hole disposed proximate at least each corner of said thin, resilient plate, each of said through holes having a diameter chosen to accept said elongated shaft and said resilient, spaced apart ribs or flanges therein, thereby adjustably securing said thin, resilient plate to each of said plurality of mounting legs.

2. The apparatus for attachment to the soundboard of a stringed musical instrument as recited in claim 1, further comprising:

c) adhesive disposed on an outer surface of said head of each of said plurality of mounting legs, said adhesive adapted for securing each of said plurality of mounting legs to a soundboard of said musical instrument.

3. The apparatus for attachment to the soundboard of a stringed musical instrument as recited in claim 2, further comprising:

d) a removable, protective barrier film disposed over said adhesive, said protective barrier film adapted for removal before mounting said plurality of mounting legs to said soundboard.

4. The apparatus for attachment to the soundboard of a stringed musical instrument as recited in claim 1, wherein each of said mounting legs comprises a cowl fastener.

5. The apparatus for attachment to the soundboard of a stringed musical instrument as recited in claim 1, wherein said width of said thin, resilient plate allows said thin, resilient plate to extend beyond the outer edges of strings of said stringed musical instrument thereby allowing sufficient width to provide a runway for a finger or pick allowing a smooth takeoff of a picking stroke, particularly when picking an outer string.

6. The apparatus for attachment to the soundboard of a stringed musical instrument as recited in claim 1, wherein said thin, resilient plate is formed from nylon 6/6 material.

7. The apparatus for attachment to the soundboard of a stringed musical instrument as recited in claim 1, wherein said thin, resilient plate is formed from nylon 6/6 material having a thickness of approximately 0.062 inch.

8. The apparatus for attachment to the soundboard of a stringed musical instrument as recited in claim 1, wherein said thin, resilient plate has, when viewed along an edge thereof perpendicular to a major axis of strings mounted on said stringed musical instrument, a shape selected from the group: flat, and slightly curved.

9. An apparatus for attachment to the soundboard of a stringed musical instrument for limiting the picking depth, comprising:

a) a plurality of substantially circular retaining cups each adapted for receiving and retaining a head of a mounting leg therein, said head of said mounting leg being free to rotate within said retaining cup;

b) a plurality of mounting legs each having a head disposed in a respective one of said plurality of mounting cups and an elongated shaft disposed perpendicularly to and extending away from said head, said elongated shaft having a diameter and a continuous thread disposed therealong; and c) a thin, resilient plate having a shape chosen from the group: a rectangle, and a trapezoid disposed between a lower surface of a group of strings of said stringed musical instrument and a soundboard thereof, said thin, resilient plate being disposed substantially parallel to said soundboard and having a width, and a through hole disposed proximate at least each corner of said thin, resilient plate, each of said through holes having a diameter chosen to threadably receive and retain said threaded elongated shaft therein.

10. The apparatus for attachment to the soundboard of a stringed musical instrument for limiting the picking depth as recited in claim 9, wherein each of said plurality of substantially circular retaining cups comprises a bottom surface and a side wall extending upwardly therefrom, said side wall being open along a portion of the circumference thereof, said open portion providing access to a portion of a perimeter of said head of said mounting leg retained in said retaining cup.

11. The apparatus for attachment to the soundboard of a stringed musical instrument for limiting the picking depth as recited in claim 10, wherein said head of each of said plurality mounting legs comprises a knurled surface on a perimeter thereof.

12. The apparatus for attachment to the soundboard of a stringed musical instrument for limiting the picking depth as recited in claim 9, further comprising:

d) adhesive disposed on a bottom surface of each of said plurality of retaining cups, said adhesive adapted for securing each of said plurality of mounting cups to said soundboard of said musical instrument.

13. The apparatus for attachment to the soundboard of a stringed musical instrument for limiting the picking depth as recited in claim 9, further comprising:

e) a removable, protective barrier film disposed over said adhesive, said protective barrier film adapted for removal before mounting said plurality of retaining cups to said soundboard.

14. The apparatus for attachment to the soundboard of a stringed musical instrument as recited in claim 9, wherein said thin, resilient plate has, when viewed along an edge thereof perpendicular to a major axis of strings mounted on said stringed musical instrument, a shape selected from the group: flat, and slightly curved.

* * * * *